US008573127B2

(12) United States Patent
Sullivan et al.

(10) Patent No.: US 8,573,127 B2
(45) Date of Patent: Nov. 5, 2013

(54) PRESSURE-RELIEF SYSTEM FOR GUN FIRED CANNON CARTRIDGES

(75) Inventors: Kevin Michael Sullivan, Kennebunk, ME (US); Brian Desmarais, Kennebunk, ME (US)

(73) Assignee: KMS Consulting LLC, Kennebunk, ME (US)

( * ) Notice: Subject to any disclaimer, the term of this patent is extended or adjusted under 35 U.S.C. 154(b) by 322 days.

(21) Appl. No.: 12/875,402

(22) Filed: Sep. 3, 2010

(65) Prior Publication Data

US 2012/0204750 A1 Aug. 16, 2012

Related U.S. Application Data

(60) Provisional application No. 61/239,464, filed on Sep. 3, 2009.

(51) Int. Cl.
*F41A 17/16* (2006.01)

(52) U.S. Cl.
USPC ..... 102/481; 102/469; 102/473

(58) Field of Classification Search
USPC ..... 102/430, 439, 440, 441, 464, 469, 470, 102/471, 472, 473, 481
See application file for complete search history.

(56) References Cited

U.S. PATENT DOCUMENTS 1,301,382 A 4/1919 Buckingham
3,665,857 A * 5/1972 Radnich et al. ..... 102/481
3,927,791 A * 12/1975 Hershberger ..... 220/89.4
4,084,512 A * 4/1978 San Miguel ..... 102/531
4,211,386 A * 7/1980 Yocum et al. ..... 251/122
4,706,929 A * 11/1987 Kalaskie et al. ..... 251/14
4,750,510 A * 6/1988 Short, III ..... 137/1
4,800,948 A * 1/1989 Visnic ..... 164/63
4,892,038 A 1/1990 Lubbers
5,002,085 A * 3/1991 FitzGerald ..... 137/68.27
5,080,124 A * 1/1992 McGregor et al. ..... 137/68.26
5,257,819 A * 11/1993 Frantom et al. ..... 280/737
5,267,666 A * 12/1993 Hinrichs et al. ..... 220/89.2
5,786,544 A * 7/1998 Gill et al. ..... 102/481
5,936,189 A 8/1999 Lubbers
6,099,033 A * 8/2000 Jenkins et al. ..... 280/737

(Continued)

*Primary Examiner* — Bret Hayes
*Assistant Examiner* — Derrick Morgan
(74) *Attorney, Agent, or Firm* — Karl F. Milde, Jr.; Eckert Seamans Cherin & Mellott, LLC

(57) ABSTRACT

A high velocity cartridge munition comprises a cartridge shell and a projectile inserted into it. A propulsion chamber within the cartridge shell receives a propulsive charge that may be ignited by a pyrotechnic igniter and that develops propulsive gases that act on the base of the projectile, driving it out of the cartridge shell. To prevent the pyrotechnic igniter from igniting spontaneously, and from igniting the propulsive charge due to the ambient temperature or because of a fire, which would cause the cartridge shell and projectile to be separated and fly apart, at least one exhaust channel between the propulsion chamber and the exterior of the cartridge shell is filled with a fusible material. The fusible material has a lower melting point than the ignition point of the igniter and of the propulsive charge. If the ambient temperature of the cartridge shell rises above the melting point of the fusible material, it melts, releasing the exhaust channels, so that, upon delayed ignition of the propulsive charge, it burns without pressure buildup, and the cartridge shell and projectile remain together. At least one non-fusible, rupturable member is positioned between the fusible material and the propulsive charge to provide mechanical support under normal conditions but to facilitate release of gases if the propulsive charge ignites.

19 Claims, 2 Drawing Sheets

(56) References Cited

U.S. PATENT DOCUMENTS

| | | | | |
|---|---|---|---|---|
| 6,305,291 | B1 * | 10/2001 | Karlsson et al. | 102/466 |
| 7,107,909 | B2 * | 9/2006 | Haeselich | 102/470 |
| 7,322,295 | B1 | 1/2008 | Haeselich | |
| 8,020,577 | B1 * | 9/2011 | Gabel et al. | 137/68.23 |
| 2001/0022353 | A1 * | 9/2001 | Takeda et al. | 251/276 |
| 2003/0102051 | A1 * | 6/2003 | Hasaka et al. | 141/325 |
| 2005/0089455 | A1 * | 4/2005 | Marganski et al. | 422/168 |
| 2006/0027126 | A1 * | 2/2006 | Aumasson et al. | 102/481 |
| 2007/0272112 | A1 | 11/2007 | Nielson et al. | |
| 2008/0006170 | A1 * | 1/2008 | Haeselich | 102/470 |
| 2008/0178938 | A1 * | 7/2008 | Stokes et al. | 137/68.23 |
| 2009/0084282 | A1 * | 4/2009 | O'Dwyer | 102/438 |
| 2009/0266816 | A1 * | 10/2009 | Holroyd et al. | 220/203.01 |
| 2010/0122640 | A1 * | 5/2010 | Ljungwald et al. | 102/481 |
| 2010/0122735 | A1 * | 5/2010 | Schramm et al. | 137/68.19 |
| 2011/0049851 | A1 * | 3/2011 | Stevens et al. | 280/741 |
| 2011/0056403 | A1 * | 3/2011 | Hays et al. | 102/481 |

* cited by examiner

PRESSURE-RELIEF SYSTEM FOR GUN FIRED CANNON CARTRIDGES

CROSS-REFERENCE TO RELATED APPLICATION

This application is based upon and claims the priority of U.S. Provisional Patent Application Ser. No. 61/239,464, filed Sep. 3, 2009, incorporated herein in its entirety by reference.

FIELD OF THE INVENTION

This invention relates to a cartridge munition having a pressure relief system, particularly to a higher velocity, gun fired cannon cartridge.

BACKGROUND OF THE INVENTION

A cartridge munition comprises a cartridge shell and a projectile inserted into it, with the cartridge shell mechanically attached to the projectile. A propulsion chamber is provided at the base of the cartridge shell to receive a propulsive charge that, for example, may be ignited using an igniter cap. After ignition, propulsive gases from the propulsive charge act on the base of the projectile so that, upon release of the mechanical bond between cartridge shell and projectile, the projectile is driven out of the cartridge shell.

Such a cartridge munition is described in Lubbers, U.S. Pat. No. 5,936,189. This cartridge munition is used with rapid-fire weapons of medium caliber (about 40 mm). Many such cartridges are received into a belt that is fed to the rapid-fire weapon. The propulsion chamber in the cartridge shell is sub-divided into a high-pressure chamber into which the propulsive charge is placed and a low-pressure chamber that is connected with the high-pressure chamber via exhaust apertures. The cartridge shell and projectile are mechanically connected via a central threaded connection that is formed as an intended-break point.

When the propulsive charge is ignited pyrotechnically in the high-pressure chamber by means of an igniter cap, the propulsive charge burns, and propulsive gases are created at high pressure that then act on the projectile base in both chambers. This drives the projectile out of the cartridge shell, after the intended-break point between cartridge shell and projectile is broken.

A similar cartridge munition is described in Lubbers, U.S. Pat. No. 4,892,038.

Such cartridge munitions are used in large quantities, and must both be safely stored and safely transported from the manufacturer to the user. Storage and transport are generally performed using larger cases, e.g., metal cases that hold a large quantity of such cartridges.

In spite of the considerable quantity of igniter material for igniter caps and propulsive charge located within a storage or transport container, storage and transport are generally simple. However, a fire in the storage or transport system during which temperatures reach or exceed about 220° C. presents a risk.

At such temperatures, the pyrotechnic igniter charge of the igniter cap can combust spontaneously, igniting in turn the propulsive charge that otherwise would have ignited at a temperature of from about 320° C. to about 400° C. After the propulsive charge ignites, as during regular firing, enough pressure develops in the propulsion chamber to act on the base of the projectile to eventually rupture the mechanical connection between cartridge shell and projectile, causing them to fly apart explosively.

Significant damage may result simply from the quantity of exploded propulsive charges of a large number of cartridges. The cartridge shell and projectile may cause great damage while flying apart, the cartridge shell and projectile acting as quasi projectiles. Any storage or transport containers involved will be destroyed, whereby the separated cartridge shells and projectiles may endanger humans and cause major mechanical damage.

Haeselich, U.S. Pat. No. 7,107,909 describes the use of a fusible material to prevent unwanted ignition of munitions due to, for example, exposure to fire. The technology described in the Haeselich patent provides for adequate containment in a standard cartridge. However, this technology may be limited in a variety of applications requiring higher working pressures, such as high speed, high velocity ammunitions. More specifically, in some instances proper pressure integrity may not be achievable through the use of the geometric means and potential material selections described in the Haeselich patent.

SUMMARY OF THE INVENTION

It is an object of the invention to prevent separation of the cartridge shell from the projectile when there is a sharp increase in ambient temperature above the ignition temperature of the pyrotechnic igniter charge in a high pressure cartridge.

It is also an object of the invention is to prevent damage to the environment caused by a collection of many such cartridges, e.g., in a storage or transport container, upon sharp increase in ambient temperature such as caused by a fire.

It is a further object of the invention is to weaken the effect of the main charge after ignition of the igniter charge so that neither large pressure damage nor major mechanical damage results from unwanted ignition of high pressure cartridges.

It is yet a further object of the invention to so configure a high pressure cartridge munition that the characteristics of the cartridge munition are not influenced by these preventive measures.

According to the invention, a cartridge munition comprising a projectile and a cartridge shell has a propulsion chamber with passages that exit from the propulsion chamber and penetrate the wall of the cartridge shell. These passages are filled with a solid, pressure-tight, fusible filler material, and the melting point of the fusible filler material is lower than the minimum ignition temperature of any pyrotechnic charge in the munition, i.e., lower than the ignition temperature of the pyrotechnic igniter charge and the propulsive charge. One or more rupturable, non-fusible, mechanical support or relief members that add additional mechanical support are positioned adjacent to the upper surface or upper surfaces of the fusible filler material.

While neither the fusible filler material nor the non-fusible support or relief member may alone be suitable for certain high pressure applications, the combination of these two features provides both proper pressure integrity and overtemperature relief capability.

The rupturable support or relief members are positioned above or adjacent the fusible filler material, that is, between, the fusible filler material and the propulsive charge or propellant. More specifically, the fusible filler material is "capped" by, or enclosed in, non-fusible material of the support or relief member, such as a disk, a cap, or an annular ring. The resulting assembly, that is, the non-fusible metal relief member and the fusible filler material, provides a useful solution to provide support to the propellant when appropriate but prevent unwarranted ignition of higher pressure types of ammunition.

The pressure relief members disclosed herein are designed to fail when the propellant "outgases" or otherwise burns. In these circumstances, the relief members facilitate venting of propellant gases either (1) to preclude separation of the projectile from the cartridge shell or (2) to significantly reduce the energy (velocity) of a projectile. This disabling characteristic prevents inadvertent fuse function (because the "setback energy" is inadequate to provide for fuse function), which prevents detonation and precludes possible loss of life.

The fusible material is preferably a fusible metal. Such fusible metals useful according to the invention include alloys of bismuth and tin. Lead or alloys thereof, etc., may also be used.

If a cartridge of the type described herein is heated to the melting temperature of the fusible material or metal, for example, to about 180° C., then the fusible material in the passages within the cartridge shell, that connect the propulsion chamber to the outside, melts. If the temperature continues to increase and the igniter cap and thereby the propulsive charge are ignited, then no pressure may build up within the propulsion chamber because the freed passages function as pressure-relief apertures. The result is that propulsive charge merely burns, whereby the propulsive gases thus created may escape via the pressure-relief apertures. Cartridge shells and projectiles are thus not separated from each other, so that neither pressure damage nor mechanical damage may occur.

The passages between the propulsive charge and the outside of the cartridge shell may be configured in many different ways: for example, the housing of the igniter cap may be made of such a fusible material or metal; also, pressure-relief apertures around the igniter cap may be filled with the fusible material. Either two or four apertures are recommended for one embodiment of the invention. Another option is to provide apertures from the propulsion chamber penetrating the sidewall of the cartridge shell.

However configured, the passages and rupturable members must be so shaped and configured that during a normal shot of the projectile out of the cartridge shell, the fusible material and non-fusible rupturable members withstand the high pressures within the propulsion chamber. Resistance to pressure may be increased by configuring the passages for the fusible material to be conical, decreasing toward the outside, or as stepped or threaded holes, etc.

In one preferred embodiment of the invention, a cartridge munition comprises a cartridge shell and a projectile inserted into the cartridge shell and mechanically connected to the cartridge shall, wherein a pyrotechnic propulsive charge is located in a propulsion chamber of the cartridge shell that is ignited by means of a pyrotechnic igniter, and whose propulsive gases exert a force on the base of the projectile when they burn, by means of which the projectile is driven out of the cartridge shell. Passages exit from the propulsion chamber through the cartridge shell that are filled with a fusible, solid, pressure-tight material whose melting temperature is lower than the ignition temperatures of the pyrotechnic igniter and the propulsive charge of the projectile. At least one non-fusible, rupturable member is positioned between the fusible, solid, pressure-tight material and the propulsive charge.

In another embodiment of the cartridge munition of the invention, the fusible solid material is a fusible metal.

In another embodiment of the cartridge munition of the invention, fusible material is an alloy of at least bismuth and tin.

In another embodiment of the cartridge munition of the invention, the fusible material is a bismuth/tin alloy with from about 30 to about 40% by weight of bismuth and from about 60 to about 70% by weight of tin, having a melting point of from about 140° C. to about 175° C.

In another embodiment of the cartridge munition of the invention, the passages are channels that extend from the base of the propulsion chamber to the outer base of the cartridge shell.

In another embodiment of the cartridge munition of the invention, the channels are positioned around the igniter of the propulsive charge.

In another embodiment of the cartridge munition of the invention, the channels narrow as they progress from the base of the propulsion chamber to the exit.

In another embodiment of the cartridge munition of the invention, the channels narrow conically.

In another embodiment of the invention, the channels are stepped drillings.

In another embodiment of the cartridge munition of the invention, the non-fusible, rupturable members are disks or caps or comprise an annular ring.

In another embodiment of the cartridge munition of the invention, each non-fusible, rupturable member is scored or weakened.

In another embodiment of the cartridge munition of the invention, each non-fusible, rupturable member is made of metal or a rigid polymeric material.

In another embodiment of the cartridge munition of the invention, the metal is copper, steel, stainless steel, aluminum, or brass.

In another embodiment of the cartridge munition of the invention, the polymeric material is a polycarbonate or polystyrene polymer or copolymer.

In another embodiment of the cartridge munition of the invention, at least one of the at least one passages exits from the propulsion chamber through a sidewall of the cartridge shell.

In another embodiment of the cartridge munition of the invention, the rupture member comprises a solid material without sufficient strength to sustain normal operating pressures in the absence of additional mechanical support.

In another embodiment of the cartridge munition of the invention, the rupture member comprises a solid material that has been modified to prevent sustaining normal operating pressures in the absence of additional mechanical support.

In another embodiment of the cartridge munition of the invention, the rupture member is made from the cartridge casing material by incomplete penetration of at least one passage exit.

In another embodiment of the cartridge munition of the invention, each passage is filled with a pressure-tight assembly comprising a solid, non-fusible rupture disk or cap that is mechanically reinforced by a fusible, solid material whose melting temperature is lower than the ignition temperature of the pyrotechnic igniter and the propulsive charge of the projectile.

In another embodiment of the cartridge munition of the invention, the pressure-tight assembly is removable by threaded or other mechanical means.

For a full understanding of the present invention, reference should now be made to the following detailed description of the preferred embodiments of the invention as illustrated in the accompanying drawings.

DETAILED DESCRIPTION OF PREFERRED EMBODIMENTS

Figure 1:
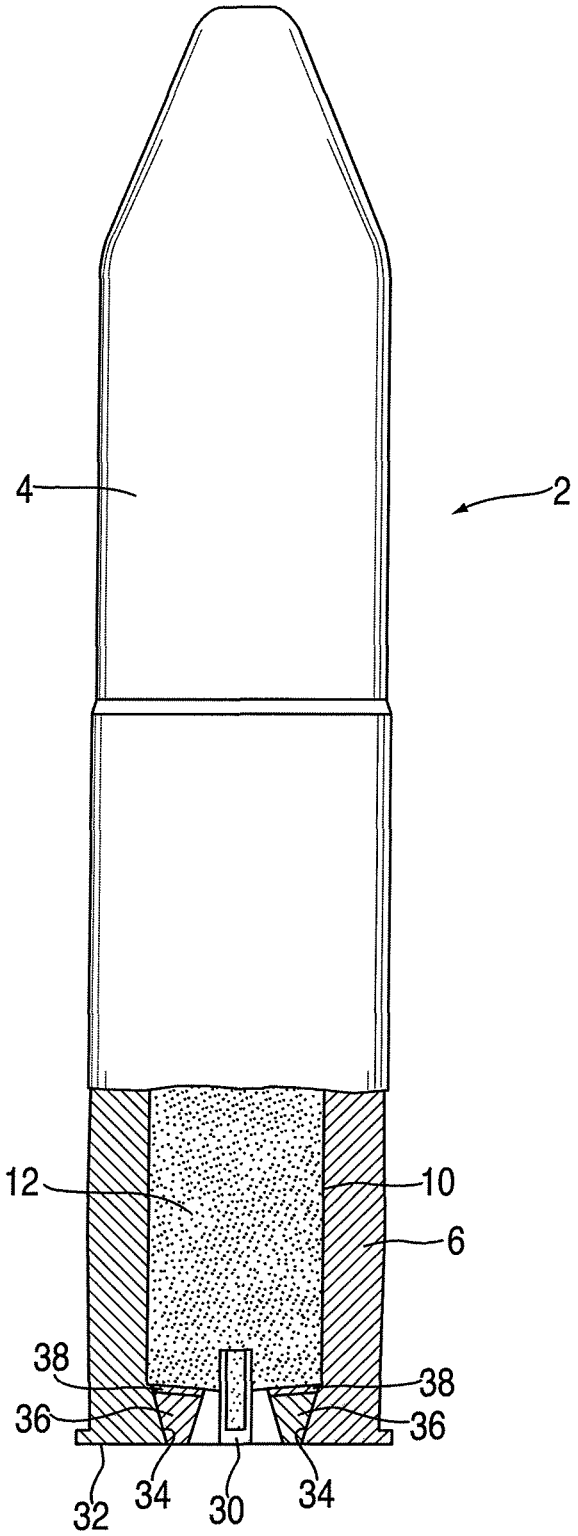
FIG. 1 is a longitudinal section through a cartridge munition consisting of a projectile and a cartridge shell that incorporates a propulsion chamber with a propulsive charge whereby, according to the invention, a non-fusible rupturable member and pressure-relief apertures are provided between the propulsion chamber and the outer wall of the cartridge shell.

The preferred embodiments of the present invention will now be described with reference to FIGS. 1 to 3 of the drawings. Identical elements in the various figures are designated with the same reference numerals.

A cartridge munition 2 shown in FIG. 1 consists of a projectile 4 and a cartridge shell 6. Cartridge shell 6 includes a propulsion chamber 10 in which a propulsive charge 12 is positioned.

Cartridge 2 possesses a caliber of from 40 mm, for example, and is fired from a tube weapon (not shown) with a twist, for which purpose the projectile possesses a guide- or twist-band (indicated only).

Propulsive charge 12 is ignited pyrotechnically by means of an igniter cap 30 whereby igniter cap 30 is mounted in the center of the base 32 of cartridge shell 6.

Passages are provided between the propulsion chamber 10 and base 32 of cartridge shell 6. Here, conical channels 34 decrease in size in the direction of base 32 of cartridge shell 6. Channels 34 possess a diameter of 7 mm for a 40 mm-caliber projectile, for example, and narrow down to about 6 mm.

By way of example, two, three, or four channels 34 are provided, symmetrical to the central longitudinal line or axis of projectile 2 and to igniter cap 30. Channels 34 are positioned symetrically around igniter cap 30. Passages 34 are filled with a fusible metal 36.

A rupturable or frangible disk or cap 38 is positioned between (1) fusible metal 36 in channels 34 and (2) propulsive charge 12. Each disk or cap 38 provides extra support to fusible metal 36 in channels 34, especially in the case of a high pressure munition so that fusible metal remains intact prior to an increased temperature condition.

Fusible metal 36 is, for example, a bismuth/tin alloy with from about 30 to about 40% bismuth by weight and from about 60 to about 70% tin by weight. Dependent upon the blend, the melting point of this alloy lies between about 140° C. and about 175° C. The alloy is impact-resistant and not soluble in water. Commercially available solder alloys such as INDALLOY® 255, a bismuth-lead alloy, and INDALLOY® 281, a bismuth-tin alloy, both products of Indium Corporation of Utica, N.Y., are useful as fusible metals according to the invention.

Fusible metal 36 is cast into channels 34 after appropriate heating. Alternatively, conical rivets are made of the fusible metal that are then driven or screwed into channels 34.

Disk or cap 38 is intended to fail when mechanical support is removed, that is, when fusible material 36 melts. Disk or cap 38 comprises a metal or other rigid material, such as a polymeric material, that is adequate for containment of propulsive charge 12 in the absence of fusible material 36 melting but then is scored, weakened, or otherwise designed to fail when fusible material 36 melts. Suitable materials for annular disk or cap 38 include, but are not limited to, metals such as copper, steel, stainless steel, aluminum, or alloys thereof, such as brass, or certain polycarbonate or polystyrene polymers or copolymers.

Propulsion chamber 10 is tight and pressure-resistant toward the exterior by means of fusible metal 36 so that cartridge 2 may be fired from a tube weapon in the same way as a conventional cartridge. The combination of the conical shape of channels 34 and annular disks or caps 38 prevents fusible metal 36 from being forced from channels 34 by the high pressure in the propulsion chamber.

As mentioned above, when the ambient temperature near the cartridges rises to from about 140° to about 175° C. as the result of a fire, for example, then fusible material 36 within channels 34 melts, freeing them. When the temperature of the igniter cap 30 then continues to rise to above about 220° C., it ignites, also igniting propulsive charge 12. The propulsive gases, created when propulsive charge 12 burns, may be diverted without consequence through each disk or cap 38 and free channels 34, so that no pressure may build up within the propulsion chamber, and therefore propulsive charge 12 is also not triggered. Cartridge shell 6 and projectile 4 further remain mechanically connected via the threads 24 and 26 so that no major damage can occur, neither because of high pressure nor because of separation of cartridge shell 6 and projectile 4.

Figure 2:
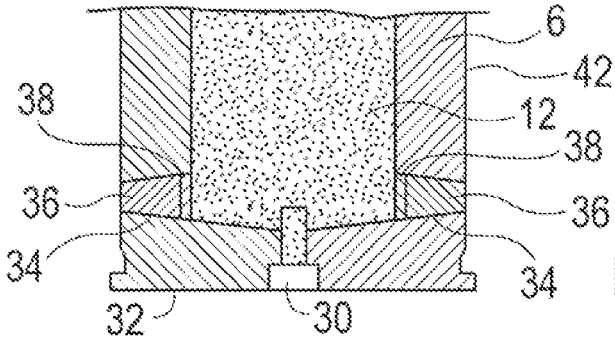
FIG. 2 is a partial schematic representation of second embodiment of a cartridge munition according to the invention where the pressure relief apertures extend to the lateral surfaces of the cartridge shell.
Figure 2A:
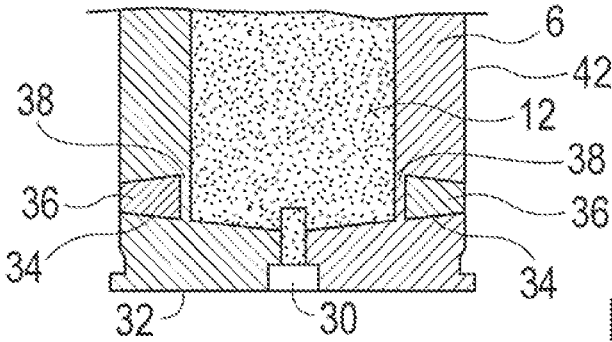
FIG. 2A is identical to FIG. 2 with the exception that the non-fusable rupturable member is made from the cartridge shell material by incomplete penetration of the pressure relief apertures through the material.

FIG. 2 is a schematic representation of a partial cross-sectional view of a cartridge shell 6 representing another embodiment of the invention. Channels 34 with fusible material 36 extend radially to the outer perimeter 42 of cartridge shell 6. Disks or caps 38, or optionally an annular ring comprising the relief member (not shown), are positioned between fusible metal 36 and propulsive charge 12. In this embodiment there can be from two to four channels 34 symmetrically arranged around cartridge 6. FIG. 2A is identical to FIG. 2 except that in this case the non-fusible, rupturable material 38 has been formed in the cartridge shell 6 by incomplete penetration of the channels 34.

Figure 3:
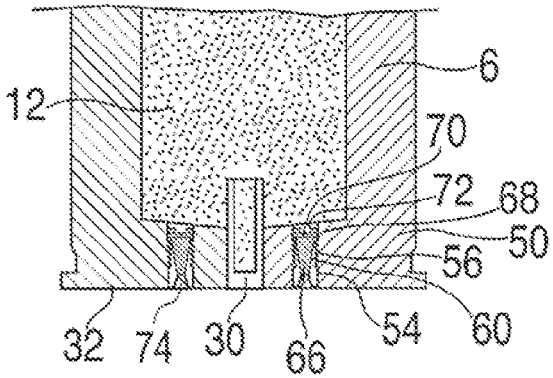
Figure 3A:
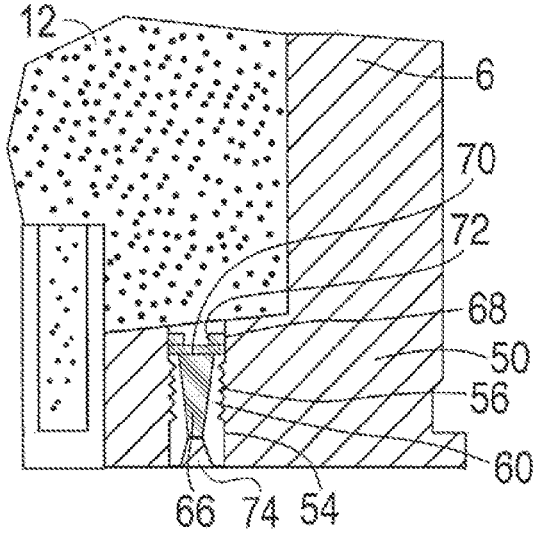

FIG. 3 is a partial schematic representation of another embodiment of the invention. In the base 50 of cartridge shell 6 each cylindrical channel 54 with threads 56 receives a cylindrical insert 60 having reciprocal threads. Each cylindrical insert 60 has a conical interior space which is filled with fusible material 66. The outer, open end of the interior space is closed by a non-fusible metal plug 74 that covers the fusible material 66. Also, each cylindrical insert 60 has a recess 68 that accommodates a non-fusible, rupturable disk 70 and a sealing O-ring 72. When cylindrical insert 60 is screwed into position within cylindrical charm 54, sealing O-ring 72 will be deformed and disk 70 will be sealingly adjacent propulsion charge 12 The arrangement can perhaps be better appreciated in the detail of FIG. 3A.

In this embodiment there can be from two to four channels 54 symmetrically arranged around cartridge shell 6.

The cartridges in FIGS. 2 and 3 may also be fired in the same way as a conventional high velocity cartridge. In case of fire or similar problem, the function is the same as described by FIG. 1.

It is also possible, of course, to use other low-melting-point materials as fusible material 36 instead of the bismuth/tin alloy mentioned as long as it is strong enough to seal the pressure-relief channels completely so that a normal shot is possible from a tube weapon.

There has thus been shown and described a novel cartridge munition, particularly one which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

We claim:

1. In a cartridge munition comprising a cartridge shell and a projectile inserted into the cartridge shell and mechanically connected to the cartridge shall, herein a pyrotechnic propulsive charge is locate in a propulsion chamber of the cartridge shell that is ignited by means of a pyrotechnic igniter, and whose propulsive gases exert a force on the base of the projectile when they burn, by means of which the projectile is driven out of the cartridge shell when the munition is chambered in a gun barrel, and wherein least one passage exits from the propulsion chamber through the cartridge shell that is substantially filled with a fusible, solid, pressure-tight material whose melting temperature is lower than the ignition temperatures of the pyrotechnic igniter and the propulsive charge of the projectile, the improvement wherein at least one non-fusible, rupturable member is positioned and forms a flat face between the fusible solid material and the propulsive charge in the propulsion chamber, and wherein a non-fusible plug is disposed in the passage containing the fusible material on the side opposite to the rupturable member, said rupturable member and said fusible solid material together having sufficient strength to withstand operating pressures within the propulsion chamber when the projectile is fired out of the cartridge shell, said rupturable material being configured to rupture and release gases from said propulsion chamber when said fusible material has melted and upon ignition of said propulsive charge when the munition is not chambered.

2. The cartridge munition of claim 1, wherein the fusible solid material is a fusible metal.

3. The cartridge munition of claim 1, wherein the fusible solid material is an alloy of at least bismuth and tin or bismuth and lead.

4. The cartridge munition of claim 3, wherein the fusible solid material is a bismuth/tin alloy with from about 30 to about 40% by weight of bismuth and from about 60 to about 70% by weight of tin, having a melting point of from about 140°C. to about 175°C.

5. The cartridge munition of claim 1, wherein the passages are channels that extend from the base of the propulsion chamber to the outer base of the cartridge shell.

6. The cartridge munition of claim 5, wherein the channels are positioned around the igniter of the propulsive charge.

7. The cartridge munition of claim 5, wherein the channels narrow as they progress from the base of the propulsion chamber to the outer base of the cartridge shell.

8. The cartridge munition claim 1, wherein each non-fusible, rupturable member is a disk or cap or form an annular ring.

9. The cartridge munition of claim 1 wherein each non-fusible, rupturable member is scored or weakened.

10. The cartridge munition claim 1, wherein each non-fusible, rupturable member is made of a metal or a rigid polymeric material.

11. The cartridge munition of claim 10, wherein the metal is copper, steel, stainless steel, aluminum, or brass.

12. The cartridge munition of claim 10, wherein the polymeric material is a polycarbonate or polystyrene polymer or copolymer.

13. The cartridge munition of claim 1, wherein at least one of the at least one passages exits from the propulsion chamber through a sidewall of the cartridge shell.

14. The cartridge munition of claim 1, wherein the rupturable member comprises a solid material without sufficient strength, in the absence of additional mechanical support, to withstand the operating pressures within the propulsion chamber when the projectile is fired out of the cartridge shell.

15. The cartridge munition of claim 1, wherein the rupturable member comprises solid material that has been modified such that, in the absence of additional mechanical support, it cannot withstand the operating pressures within the propulsion chamber when the projectile is fired out of the cartridge shell.

16. The cartridge munition of claim 1, wherein the rupturable member is made from the cartridge shell material by incomplete penetration of at least one passage exit.

17. The cartridge munition claim 1, wherein each passage is filled with a pressure-tight assembly comprising a solid, non-fusible rupture disk or cap that is mechanically reinforced by a fusible, solid material whose melting temperature is lower than the ignition temperature of the pyrotechnic igniter and the propulsive charge of the projectile.

18. The cartridge munition claim 1, wherein the pressure-tight assembly is removable by threaded or other mechanical means.

19. The cartridge munition of claim 1, wherein said non-fusible plug is metal.

* * * * *